US011484912B2

(12) United States Patent
Ma et al.

(10) Patent No.: US 11,484,912 B2
(45) Date of Patent: Nov. 1, 2022

(54) ACTIVE SORTING MUCK-COLLECTING DEVICE FOR SLURRY BALANCING SHIELD

(71) Applicants: CHINA RAILWAY TUNNEL GROUP CO., LTD., Guangzhou (CN); CHINA RAILWAY TUNNEL STOCK CO., LTD., Zhengzhou (CN)

(72) Inventors: Jian Ma, Zhengzhou (CN); Yunfeng Wang, Zhengzhou (CN); Wenqi Dong, Zhengzhou (CN); Yushuang Wang, Zhengzhou (CN); Minghui Liu, Zhengzhou (CN); Guangpu Zhang, Zhengzhou (CN); Zhaobin Liu, Zhengzhou (CN); Maoyuan Guo, Zhengzhou (CN); Chuanzhe Wang, Zhengzhou (CN); Yong Tian, Zhengzhou (CN); Jiwei Li, Zhengzhou (CN); Zhiming Zhang, Zhengzhou (CN); Jiange Li, Zhengzhou (CN)

(73) Assignees: CHINA RAILWAY TUNNEL GROUP CO., LTD., Guangzhou (CN); CHINA RAILWAY TUNNEL STOCK CO., LTD., Zhengzhou (CN)

( * ) Notice: Subject to any disclaimer, the term of this patent is extended or adjusted under 35 U.S.C. 154(b) by 0 days.

(21) Appl. No.: 17/370,262

(22) Filed: Jul. 8, 2021

(65) Prior Publication Data

US 2021/0331207 A1 Oct. 28, 2021

Related U.S. Application Data

(63) Continuation of application No. PCT/CN2020/098379, filed on Jun. 28, 2020.

(30) Foreign Application Priority Data

Sep. 5, 2019 (CN) ..... 201910836477.6

(51) Int. Cl.

| | |
|---|---|
| ***B07B 1/24*** | (2006.01) |
| ***B07B 1/50*** | (2006.01) |
| ***E21D 9/12*** | (2006.01) |

(52) U.S. Cl.

CPC ..... *B07B 1/24* (2013.01); *B07B 1/50* (2013.01); *E21D 9/12* (2013.01)

(58) Field of Classification Search

CPC .... B03B 5/56; B07B 1/24; B07B 1/50; E21D 9/12

See application file for complete search history.

(56) References Cited

U.S. PATENT DOCUMENTS 4,312,749 A * 1/1982 Bingham ..... B03B 9/005 209/44
5,312,051 A * 5/1994 Preisser ..... B01D 33/39 241/79.3

(Continued)

FOREIGN PATENT DOCUMENTS

CN 208220695 U 12/2018
CN 208341104 U 1/2019

(Continued)

OTHER PUBLICATIONS

International Search Report and Written Opinion issued in corresponding PCT Application No. PCT/CN2020/098379, dated Oct. 12, 2020.

*Primary Examiner* — Patrick H Mackey
(74) *Attorney, Agent, or Firm* — Westbridge IP LLC

(57) ABSTRACT

The present application discloses an active sorting muck-collecting device for slurry balancing shield, aiming at solving a technical problem that an existing muck-collecting device cannot provide reliable sorting function for a shield slurry circulation system. The device includes a sorting stirring cylinder, a circulation pipeline and a muck-collecting box, the sorting stirring cylinder includes an outer (Continued)

cylinder and a rotatable grid cylinder coaxially-configured. The grid cylinder is configured with a rotating shaft, and a spiral conveying mechanism is fixedly configured inside. The rotating shaft is fixedly connected with the grid cylinder. A circulation pipeline communicated with the grid cylinder is correspondingly configured below the grid cylinder. A muck-collecting box is fixedly configured below the circulation pipeline, and the muck-collecting box is communicated with the grid cylinder at where an output end of a slurry discharging pipeline locates.

8 Claims, 5 Drawing Sheets

(56) References Cited

U.S. PATENT DOCUMENTS

| | | | | | |
|---|---|---|---|---|---|
| 2011/0198268 | A1* | 8/2011 | DeWaard | ..... | B01D 33/11 209/270 |
| 2013/0299395 | A1* | 11/2013 | DeWaard | ..... | B07B 1/00 209/235 |

FOREIGN PATENT DOCUMENTS

| | | | | | |
|---|---|---|---|---|---|
| CN | 208482768 | U | * | 2/2019 | ..... B07B 1/22 |
| CN | 208599948 | U | | 3/2019 | |
| CN | 208845177 | U | | 5/2019 | |
| CN | 109876507 | A | | 6/2019 | |
| CN | 110523614 | A | | 12/2019 | |
| CN | 211027004 | U | | 7/2020 | |
| JP | 2013241738 | A | | 12/2013 | |

* cited by examiner

ACTIVE SORTING MUCK-COLLECTING DEVICE FOR SLURRY BALANCING SHIELD

CROSS-REFERENCE TO RELATED APPLICATIONS

This application is a continuation of International Application No. PCT/CN2020/098379, filed on Jun. 28, 2020, entitled "ACTIVE SORTING MUCK-COLLECTING DEVICE FOR SLURRY BALANCING SHIELD" which claims priority of Chinese application No. 201910836477.6, filed on Sep. 5, 2019, entitled "ACTIVE SORTING MUCK-COLLECTING DEVICE FOR SLURRY BALANCING SHIELD", which are hereby incorporated by reference in their entireties.

FIELD

The present application relates to the technical field of slurry shield equipment, in particular to an active sorting muck-collecting device for slurry balancing shield.

BACKGROUND

With the sustained and rapid growth of infrastructure construction in China, the utilization of underground space is also one of the key directions of domestic construction research at present. With the introduction of shield, the development of underground space becomes more and more convenient and safe. Slurry balance shield is widely used in underground engineering because of its better stability and more reliable safety.

Slagging of slurry balance shield depends entirely on a circulating flow of slurry, therefore, in sandy pebble strata, round gravel strata, strongly weathered rock strata, fault fracture zones, as well as calcareous mudstone, siltstone and other strata, a large number of pebbles or broken rock blocks with a particle diameter of 20 mm-250 mm will be generated due to cutting a working face during tunneling. After entering a mud bin, these large-size particles will enter a mud pipeline through mud circulation and be pumped to the ground separation equipment or slag yard through a slurry discharging pump. However, for a slurry discharging pump (P2.1 pump) of a general slurry shield, an allowed maximum particle diameter is 160 mm-200 mm. When pebbles or broken rock blocks with a particle diameter larger than 160 mm-200 mm enter the P2.1 pump, a suction port and impeller of the P2.1 pump will be blocked or stuck, resulting in inability of tunneling and the need to clean and disassemble the slurry discharging pump for a long time.

Therefore, a muck-collecting device will be configured in front of the P2.1 pump during excavation in this stratum. However, the current muck-collecting device is generally of a cylindrical box structure with a grid inside to filter pebbles or stones with large particle diameter, there will also be situations where pebbles with large particle diameter are blocked by the grid, and subsequent a large number of stones smaller than the passable particle diameter are also blocked at the grid and then fall into the muck-collecting box, resulting in that the muck-collecting box is quickly filled up and the excavation cannot be carried out. Therefore, this kind of muck-collecting device needs frequent unpacking and cleaning, which seriously reduces the efficiency of construction.

SUMMARY

The technical problem to be solved by the current application is to provide an active sorting muck-collecting device for slurry balancing shield, so as to solve the technical problem that an existing muck-collecting device cannot provide reliable sorting function for a slurry circulation system of a shield.

In order to solve the above technical problems, the current application adopts the following technical scheme.

An active sorting muck-collecting device for slurry balancing shield is designed, including a sorting stirring cylinder, a circulation pipeline and a muck-collecting box, the sorting stirring cylinder includes an outer cylinder and a rotatable grid cylinder coaxially configured; the grid cylinder is configured with a rotating shaft, and a spiral conveying mechanism is fixedly configured inside the grid cylinder, the rotating shaft is fixedly connected with the grid cylinder, to realize that the rotating shaft drives the spiral conveying mechanism of the grid cylinder to do self-rotating motion, a circulation pipeline connected with the grid cylinder is correspondingly configured below the grid cylinder, left and right ends of the circulation pipeline are respectively configured with a slurry discharging pipeline and a scouring pipeline, upper ends of the slurry discharging pipeline and the scouring pipeline are fixedly connected with the outer cylinder, the muck-collecting box is fixedly configured under the circulation pipeline, and at where an output end of the slurry discharging pipeline locates, the muck-collecting box is communicated with the grid cylinder.

Optionally, at where an output end of the scouring pipeline locates, the grid cylinder is configured with a slurry inlet pipeline communicated with the grid cylinder, and the slurry inlet pipeline is communicated with the slurry discharging pipeline through the grid cylinder and the circulation pipeline.

Optionally, a cover plate is configured on the rotating shaft at an end of the rotating shaft adjacent to the slurry inlet pipeline to protect the rotating shaft and prolong the service life of the rotating shaft.

Optionally, the spiral conveying mechanism is a spiral rib, the spiral rib has high conveying efficiency, high self-strength and long service life, and has a hole for large stones to pass through in the middle.

Optionally, three or more groups of supporting components are fixedly configured between the grid cylinder and the rotating shaft, the supporting components include two supporting rods symmetrically configured from up to down, and the supporting components are evenly distributed in the grid cylinder with a circumferential 30-degree cross dislocation, improving a general strength for the grid cylinder.

Optionally, reinforcing ribs are configured between the supporting rods and the rotating shaft, and between the supporting rods and the grid cylinder, the reinforcing ribs include two reinforcing ribs symmetrically configured from left to right, so that a support strength of the supporting rods are increased.

Optionally, an outer circumferential surface of the grid cylinder and an inner circumferential surface of the outer cylinder are both configured with wear-resistant layers. A friction force on the outer circumferential surface of the grid cylinder and the inner circumferential surface of the outer cylinder is relatively large, and the wear-resistant layers configured on the surfaces of the grid cylinder and the outer cylinder prolong the service life of the grid cylinder and the outer cylinder.

Optionally, a side surface of the muck-collecting box is configured with a cleaning opening, the cleaning opening is configured with a sealing cover plate, and the sealing cover plate is fixed with the muck-collecting box through bolts, and the setting of the cleaning opening is convenient for cleaning stones inside the muck-collecting box.

Optionally, a two-layer structure is configured inside the muck-collecting box and a slag sliding plate is further configured inside the muck-collecting box. So that the stones can obtain an initial speed when entering the muck-collecting box, and can be evenly distributed inside the muck-collecting box, avoiding an accumulation and congestion of the stones at the entrance.

Compared with the related art, main beneficial technical effects of the present application are: the structure is simple and compact, and it is convenient to manufacture and install; the self-rotation of the grid cylinder with spiral ribs inside separates large stones from small stones; the small stones enter the circulation pipeline through grids, and the large stones are sent into the muck-collecting box by the spiral ribs, thus greatly reducing the cleaning frequency of the muck-collecting box and further improving the tunneling efficiency.

DETAILED DESCRIPTION OF THE EMBODIMENTS

Detailed description of embodiments of the present application will be described below with reference to the accompany drawings and examples, but the following examples are intended only to illustrate the current application in detail and are not intended to limit the scope of the current application in any way.

The parts referred to in the following examples are conventional commercially available products unless otherwise specified.

Figure 1:
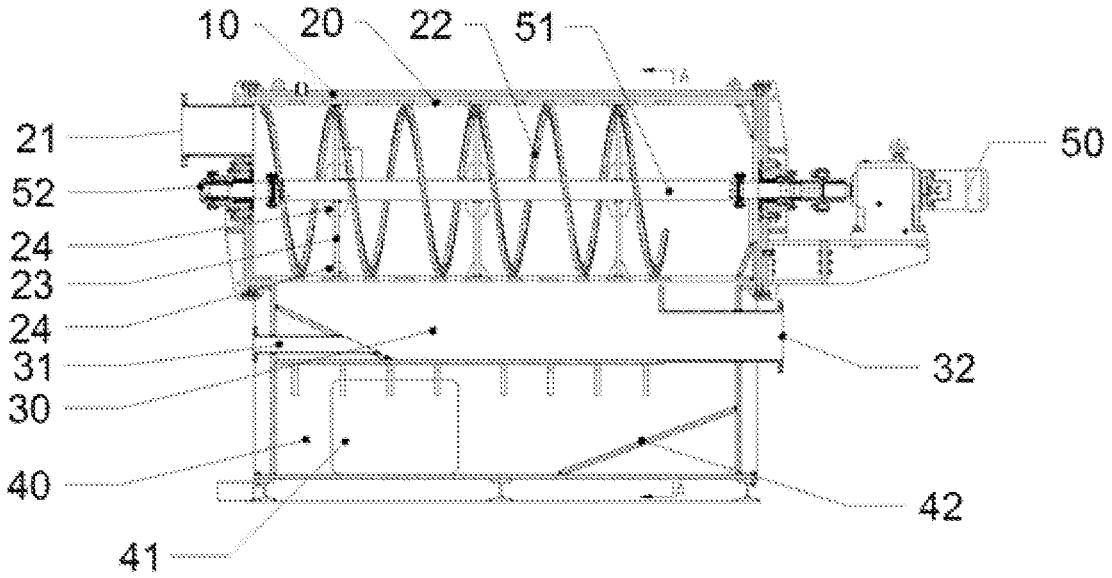
FIG. 1 is a schematic view of a transverse section structure of an active sorting muck-collecting device for slurry balancing shield.
Figure 2:
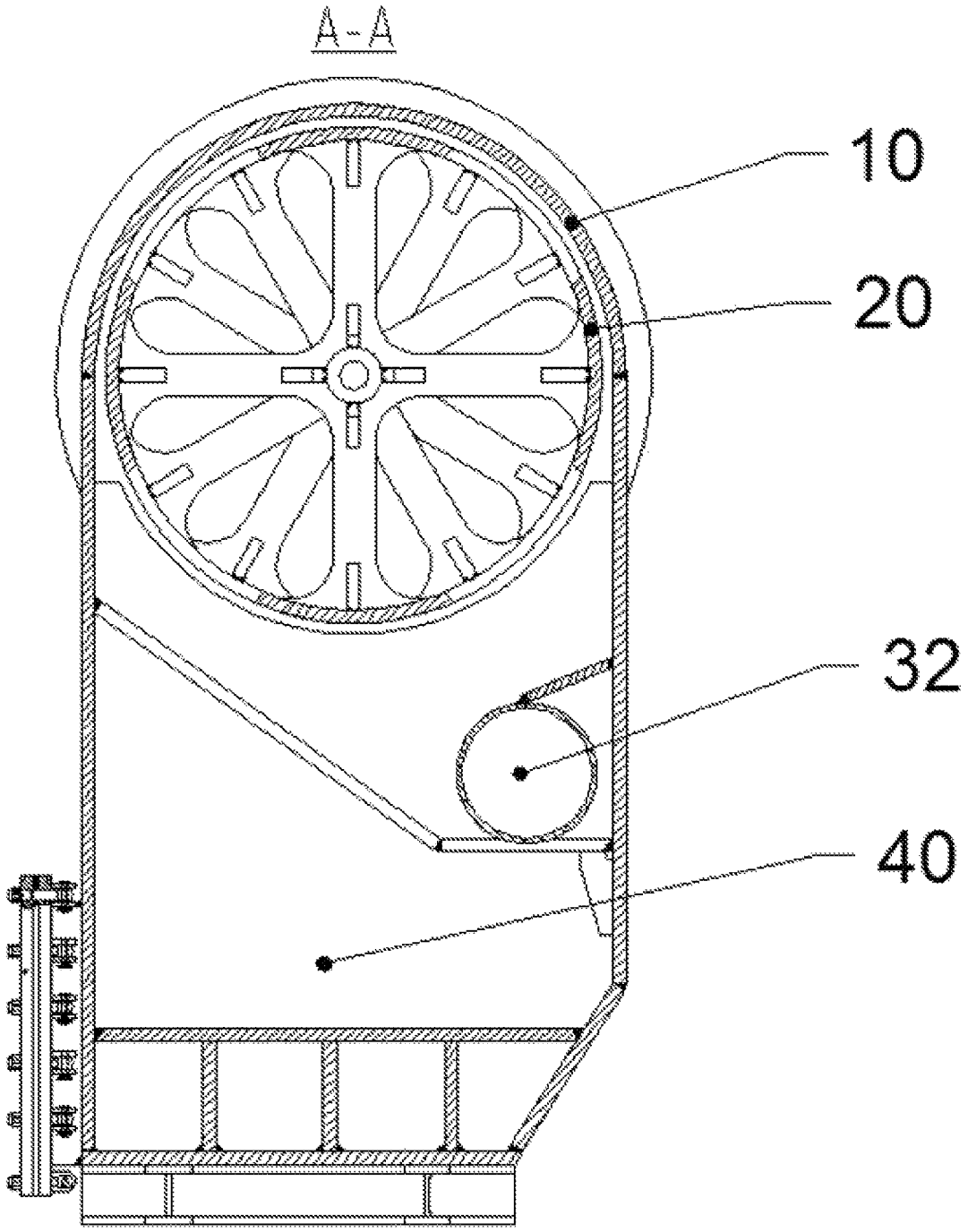
FIG. 2 is a schematic view of an A-A section structure of the active sorting muck-collecting device for slurry balancing shield.
Figure 3:
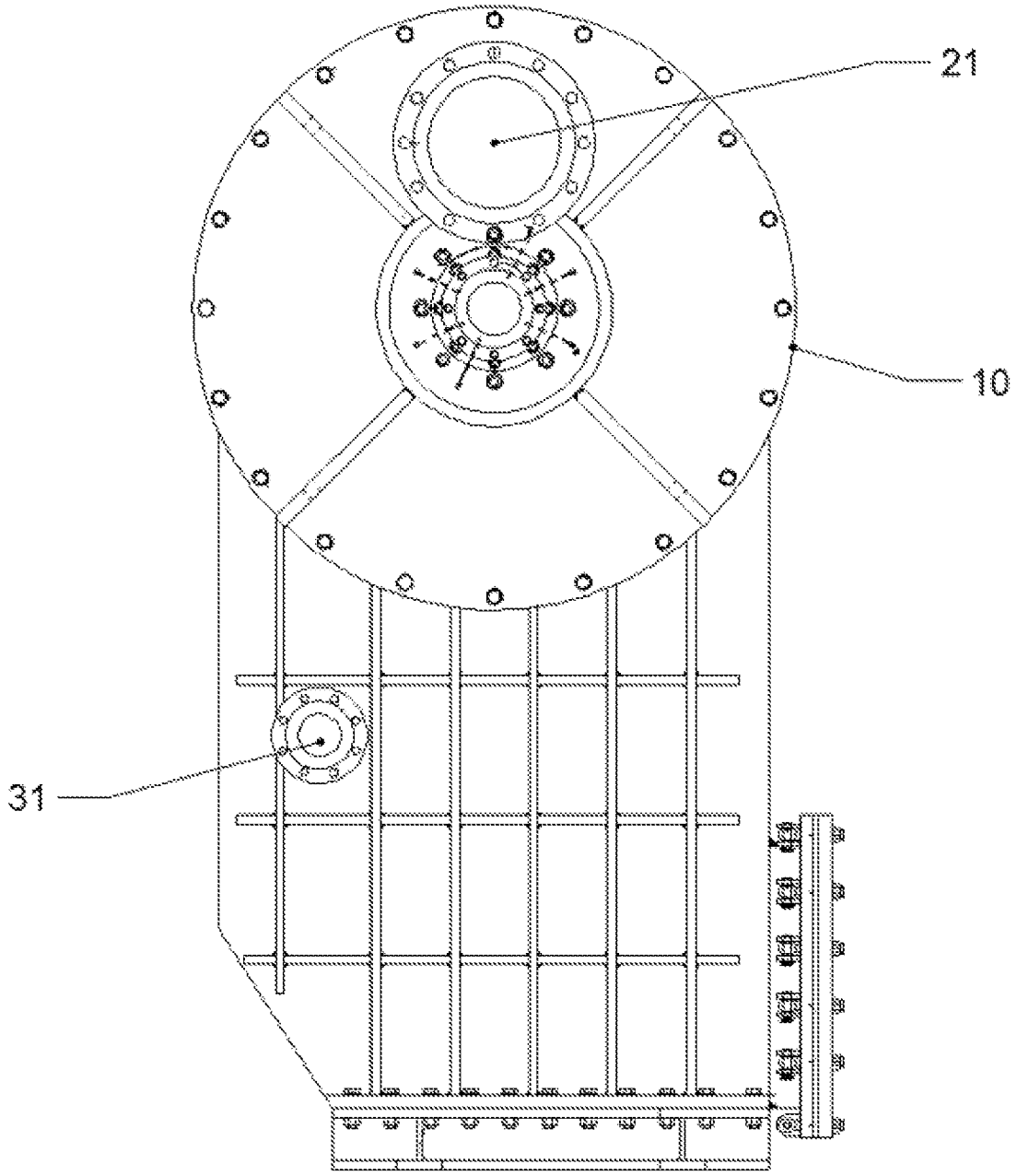
FIG. 3 is a schematic left view of the active sorting muck-collecting device for slurry balancing shield.
Figure 4:
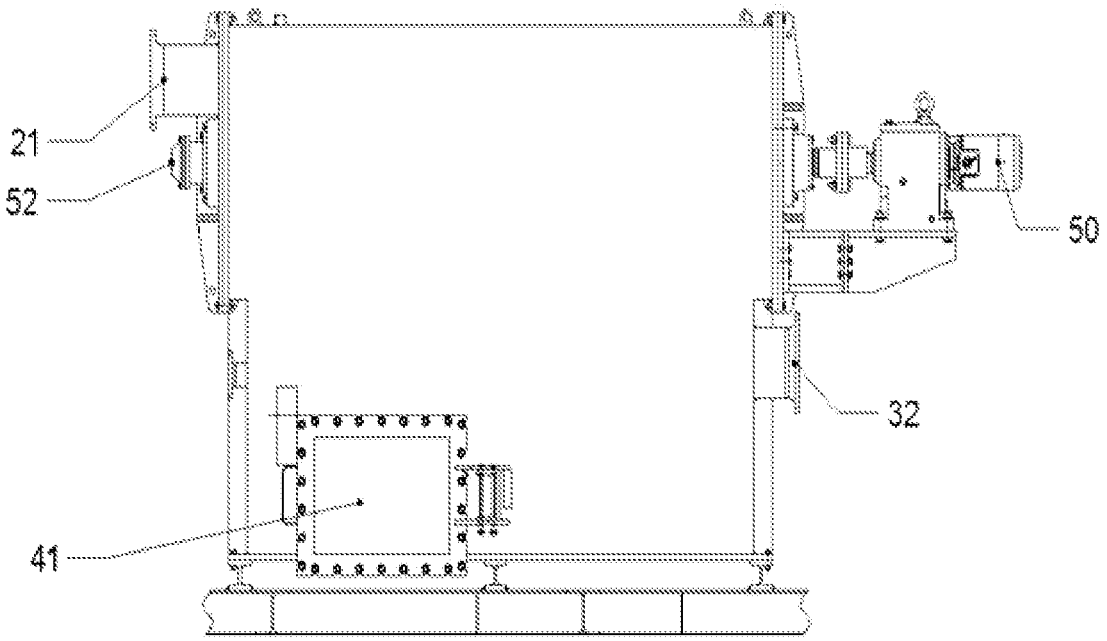
FIG. 4 is a schematic front view of the active sorting muck-collecting device for slurry balancing shield.
Figure 5:
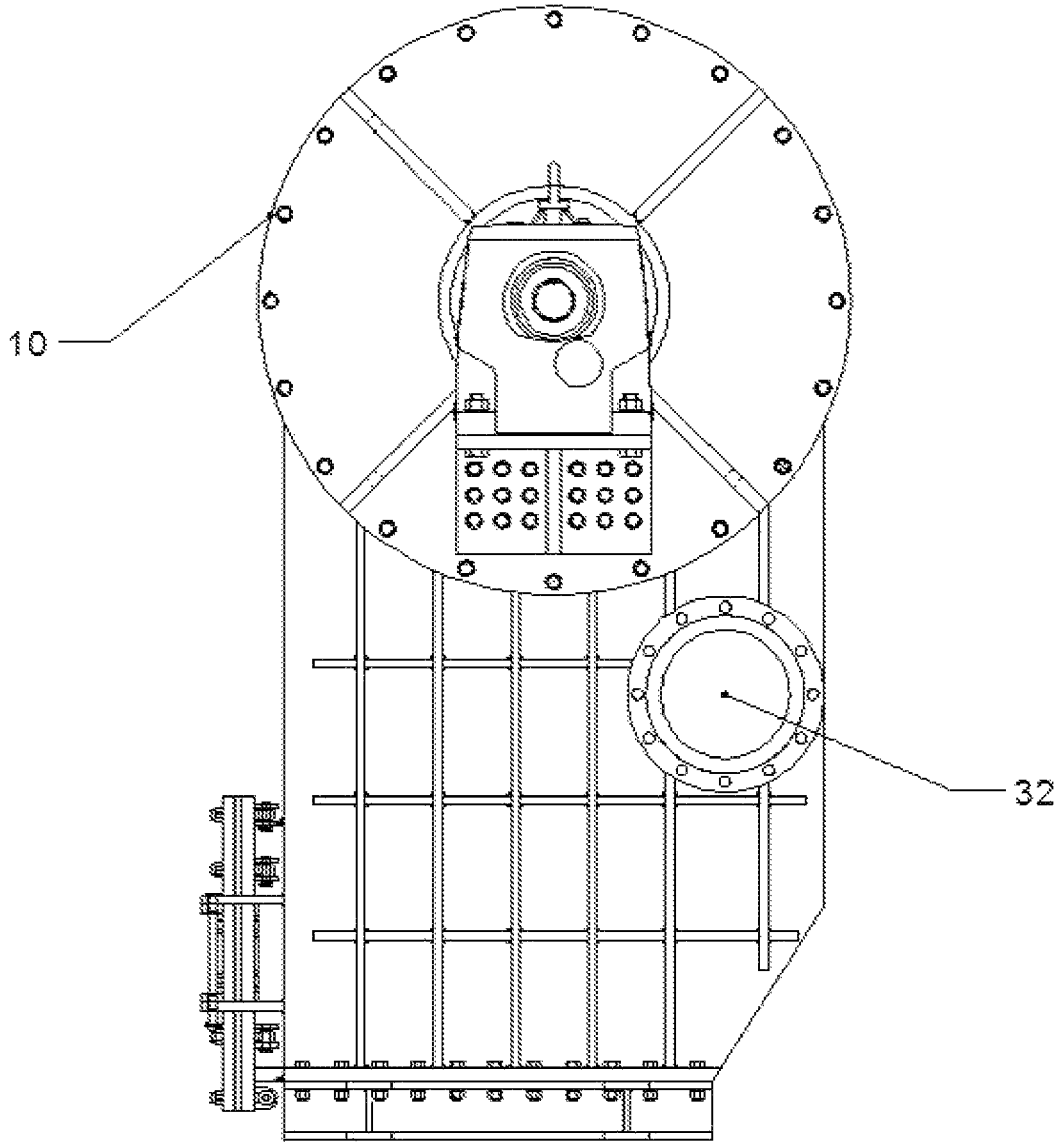
FIG. 5 is a schematic right view of the active sorting muck-collecting device for slurry balancing shield.

In one embodiment, an active sorting muck-collecting device for slurry balancing shield, referring to FIGS. 1 to 5, includes a sorting stirring cylinder, a circulation pipeline 30, a muck-collecting box 40 and a driving motor 50. The sorting stirring cylinder includes an outer cylinder 10 and a rotatable grid cylinder 20 coaxially configured. The grid cylinder 20 is configured with a rotating shaft 51, and a spiral conveying mechanism is fixed and embedded inside. The spiral conveying mechanism is a spiral rib 22, which has high conveying efficiency, high self-strength and long service life, and has a hole for large stones to pass through in the middle. The rotating shaft 51 is connected with the driving motor 50, and is welded and fixed with the grid cylinder 20 to realize that the driving motor drives the rotating shaft and drives the spiral conveying mechanism of the grid cylinder to perform self-rotating motion. A cover plate is configured on the rotating shaft to protect the rotating shaft and prolong the service life of the rotating shaft, a rotating shaft fixing frame is also configured on the rotating shaft, and a rolling bearing is configured between the rotating shaft and the rotating shaft fixing frame. An outer circumferential surface of the grid cylinder and an inner circumferential surface of the outer cylinder are both configured with wear-resistant layers. A friction force on the outer circumferential surface of the grid cylinder and the inner circumferential surface of the outer cylinder is relatively large, and the wear-resistant layers configured on the surfaces of the grid cylinder and the outer cylinder prolong the service life of the grid cylinder and the outer cylinder.

Three groups of supporting components are fixedly welded between the grid cylinder and the rotating shaft, the supporting components include two supporting rods symmetrically configured from up to down, and the supporting components are evenly distributed inside the grid cylinder in a circumferential direction of 30-degree, so that an overall strength of a grid roller is improved. Reinforcing ribs 24 are welded between a supporting rod 23 and the rotating shaft 51, and between the supporting rod 23 and the grid cylinder 20. There are two reinforcing ribs 24 and the two reinforcing ribs 24 are configured symmetrically from left to right, so that a support strength of the supporting rods 23 are increased. The circulation pipeline 30 communicating with the grid cylinder 20 is correspondingly configured below the grid cylinder 20. A slurry discharging pipeline 32 and a scouring pipeline 31 are respectively arranged at a left end and a right end of the circulation pipeline 30. The scouring pipeline 31 prevents mud from remaining in the circulation pipeline 30, and a slurry inlet pipeline 21 is configured on the grid cylinder 20 and in communication with the grid cylinder 20 at an end where an output end of the scouring pipeline 31 locates, so that the slurry inlet pipeline 21 is communicated with the slurry discharging pipeline 32 through the grid cylinder 20, and the circulation pipeline 30 is communicated with the slurry discharging pipeline 32.

Upper ends of the slurry discharging pipeline 32 and the scouring pipeline 31 are connected with the outer cylinder 10 through bolts, and a muck-collecting box 40 is fixedly configured below the circulation pipeline 30. At an end where an output end of the slurry discharging pipeline 32 locates, the muck-collecting box 40 is communicated with the grid cylinder 20. A side surface of the muck-collecting box 40 is configured with a cleaning opening, and the cleaning opening is configured with a sealing cover plate 41, and the sealing cover plate 41 is fixed to the muck-collecting box 40 through bolts, and the setting of the cleaning opening is convenient for cleaning stones inside the muck-collecting box 40. A two-layer structure is configured inside the muck-collecting box 40, and a slag sliding plate 42 is also configured, so that the stones can obtain an initial speed when entering the muck-collecting box, and can be evenly distributed inside the muck-collecting box, avoiding an accumulation and congestion of the stones at the entrance.

Referring to FIGS. 1 to 5, a working process of the active sorting muck-collecting device for slurry balancing shield is as follows: the slurry inlet pipeline 21 is connected with a slurry discharging pipeline of a main machine of the shield machine. The slurry discharging pipeline 32 is connected with a P2.1 slurry discharging pump of the shield machine and its subsequent pipelines. Clay adulterated with gravel enters the grid cylinder 20 from the slurry inlet pipe. The rotation of the grid cylinder 20 drives the spiral rib 22 to stir to separate the clay and gravel. Larger stones are isolated within the grid cylinder 20, and under the action of the spiral rib 22, conveyed to the muck-collecting box 40 below the circulation pipeline 30. As the muck-collecting box 40 is full, a sealing cover plate 41 of the cleaning opening is opened to clean the muck-collecting box 40, and smaller stones and mud enter the circulation pipeline 30 below the grid cylinder 20 through the grid cylinder 20, and then are discharged into the P2.1 slurry discharging pump of the shield machine and subsequent pipelines through the slurry discharging pipeline 32 connected with the circulation pipeline 30. So that, the continuous circulation of the shield slurry circulation system can be maintained. The grid cylinder 20 and the spiral ribs 22 configured in the grid cylinder 20 of the muck-collecting device of the present application can screen stones according to sizes of the stones by self-rotation, and the circulation pipeline 30 and the muck-collecting box 40 communicating with the grid cylinder 20 can collect small stones and large stones, respectively.

Detailed description of the present application has been configured with the drawings and embodiments above. However, it will be understood by those skilled in the art that, without departing from the concept of the present application, various specific parameters in the above embodiments can be modified to form a plurality of specific embodiments, all of which are within the common range of the present application and will not be described in detail here.

The invention claimed is:

1. An active sorting muck-collecting device for slurry balancing shield comprising a sorting stirring cylinder, a circulation pipeline and a muck-collecting box, wherein the sorting stirring cylinder comprises an outer cylinder and a rotatable grid cylinder coaxially configured; the grid cylinder is configured with a rotating shaft, and a spiral conveying mechanism is fixedly configured inside the grid cylinder, the rotating shaft is fixedly connected with the grid cylinder, to realize that the rotating shaft drives the spiral conveying mechanism of the grid cylinder to do self-rotating motion;

the circulation pipeline connected with the grid cylinder is correspondingly configured below the grid cylinder, a left end and a right end of the circulation pipeline are respectively configured with a slurry discharging pipeline and a scouring pipeline, upper ends of the slurry discharging pipeline and the scouring pipeline are fixedly connected with the outer cylinder; and the muck-collecting box is fixedly configured under the circulation pipeline, and at where an output end of the slurry discharging pipeline locates, the muck-collecting box is communicated with the grid cylinder;

wherein three or more groups of supporting components are fixedly configured between the grid cylinder and the rotating shaft, the supporting components comprise two supporting rods symmetrically configured from up to down, and the supporting components are evenly distributed in the grid cylinder with a circumferential 30-degree cross dislocation.

2. The active sorting muck-collecting device for slurry balancing shield according to claim 1, wherein at where an output end of the scouring pipeline locates, the grid cylinder is configured with a slurry inlet pipeline communicated with the grid cylinder, and the slurry inlet pipeline is communicated with the slurry discharging pipeline through the grid cylinder and the circulation pipeline.

3. The active sorting muck-collecting device for slurry balancing shield according to claim 1, wherein a cover plate is configured on the rotating shaft at an end of the rotating shaft adjacent to the slurry inlet pipeline.

4. The active sorting muck-collecting device for slurry balancing shield according to claim 1, wherein the spiral conveying mechanism is a spiral rib.

5. The active sorting muck-collecting device for slurry balancing shield according to claim 1, wherein reinforcing ribs are configured between the supporting rods and the rotating shaft, and between the supporting rods and the grid cylinder, the reinforcing ribs comprise two reinforcing ribs symmetrically configured from left to right.

6. The active sorting muck-collecting device for slurry balancing shield according to claim 1, wherein an outer circumferential surface of the grid cylinder and an inner circumferential surface of the outer cylinder are both configured with wear-resistant layers.

7. The active sorting muck-collecting device for slurry balancing shield according to claim 1, wherein a side surface of the muck-collecting box is configured with a cleaning opening, the cleaning opening is configured with a sealing cover plate, and the sealing cover plate is fixed with the muck-collecting box through bolts.

8. The active sorting muck-collecting device for slurry balancing shield according to claim 1, wherein a two-layer structure is configured inside the muck-collecting box and a slag sliding plate is further configured inside the muck-collecting box.

* * * * *